US005709495A

United States Patent [19]

Brunner

[11] Patent Number: 5,709,495

[45] Date of Patent: Jan. 20, 1998

[54] ORGANIZED APPOINTMENT BOOK FOR A HAIRSTYLIST

[76] Inventor: Pennae Brunner, 1165 Smith Ave., No. 1, Campbell, Calif. 95008

[21] Appl. No.: 759,060

[22] Filed: Dec. 2, 1996

[51] Int. Cl.[6] ..... B42F 13/00

[52] U.S. Cl. ..... 402/73; 402/70

[58] Field of Search ..... 281/36, 37, 29; 402/73, 79, 70

[56] References Cited

U.S. PATENT DOCUMENTS

| | | | |
|---|---|---|---|
| 2,505,417 | 4/1950 | Maline . | |
| 3,275,343 | 9/1966 | Holm | 283/4 |
| 4,043,063 | 8/1977 | Ambasz . | |
| 4,892,333 | 1/1990 | Krulich | 281/36 X |
| 5,030,027 | 7/1991 | Bacharach et al. | 281/37 |
| 5,294,208 | 3/1994 | Tremmel, Jr. et al. | 402/73 X |
| 5,387,011 | 2/1995 | Freund . | |
| 5,489,120 | 2/1996 | Thornburg | 281/36 |

*Primary Examiner*—Willmon Fridie, Jr.
*Attorney, Agent, or Firm*—Michael I. Kroll

[57] ABSTRACT

An organize appointment book for a hairstylist (10) comprising a loose-leaf binder (12) having a front cover (14) and back cover (16) hinged to a spine (18). A page holder (20) is mounted to the spine (18). A plurality of imprinted pages (22) are detachably held by the page holder (20). Each imprinted page (22) bears printed indicia (24) thereon for providing information to the hairstylist using the organize appointment book (10).

1 Claim, 6 Drawing Sheets

22
46
1997
FEBRUARY 1
SATURDAY
TIME
PHONE
STYLIST CLIENTS
STAND BY APPTS.
NOTES
FEBRUARY 2
SUNDAY
24

22
44
1997
FEBRUARY 1
WEDNESDAY
TIME
PHONE
STYLIST CLIENTS
ASSISTANT CLIENTS
STAND BY APPTS.
NOTES
24

Fig. 6

22 50

IMPORTANT DATES FOR 1997

24

| | | |
|---|---|---|
| JANUARY 1 | WEDNESDAY | NEW YEAR'S DAY |
| JANUARY 20 | MONDAY | MARTIN LUTHER KING, JR DAY |
| FEBRUARY 2 | SUNDAY | GROUNDHOG DAY |
| FEBRUARY 12 | WEDNESDAY | LINCOLN'S BIRTHDAY |
| FEBRUARY 12 | WEDNESDAY | ASH WEDNESDAY |
| FEBRUARY 14 | FRIDAY | VALENTINE'S DAY |
| FEBRUARY 17 | MONDAY | PRESIDENT'S DAY |
| FEBRUARY 22 | SATURDAY | WASHINGTON'S BIRTHDAY |
| MARCH 17 | MONDAY | ST. PATRICK'S DAY |
| MARCH 23 | SUNDAY | PALM SUNDAY |
| MARCH 28 | FRIDAY | GOOD FRIDAY |
| MARCH 30 | SUNDAY | EASTER SUNDAY |
| APRIL 6 | SUNDAY | DAYLIGHT SAVING TIME BEGINS |
| APRIL 22 | TUESDAY | PASSOVER |
| MAY 11 | SUNDAY | MOTHER'S DAY |
| MAY 17 | SATURDAY | ARMED FORCES DAY |
| MAY 19 | MONDAY | VICTORIA DAY (CANADA) |
| MAY 26 | MONDAY | MEMORIAL DAY (OBSVD) |
| MAY 30 | FRIDAY | MEMORIAL DAY |
| JUNE 14 | SATURDAY | FLAG DAY |
| JUNE 15 | SUNDAY | FATHER'S DAY |
| JULY 1 | TUESDAY | CANADA DAY (CANADA) |
| JULY 4 | FRIDAY | INDEPENDENCE DAY |
| SEPTEMBER 1 | MONDAY | LABOR DAY |
| OCTOBER 2 | THURSDAY | ROSH HASHANAH |
| OCTOBER 11 | SATURDAY | YOM KIPPUR |
| OCTOBER 12 | SUNDAY | COLUMBUS DAY |
| OCTOBER 13 | MONDAY | COLUMBUS DAY (OBSVD) |
| OCTOBER 13 | MONDAY | THANKSGIVING DAY (CANADA) |
| OCTOBER 24 | FRIDAY | UNITED NATIONS DAY |
| OCTOBER 26 | SUNDAY | DAYLIGHT SAVING TIME ENDS |
| OCTOBER 31 | FRIDAY | HALLOWEEN |
| NOVEMBER 11 | TUESDAY | VETERANS DAY |
| NOVEMBER 27 | THURSDAY | THANKSGIVING DAY |
| DECEMBER 24 | WEDNESDAY | HANUKKAH |
| DECEMBER 25 | THURSDAY | CHRISTMAS DAY |

Fig. 5

32 22 48

ADDRESSES & TELEPHONE NUMBERS

24

| | |
|---|---|
| NAME | NAME |
| STREET | STREET |
| CITY STATE ZIP | CITY STATE ZIP |
| PHONE ( ) | PHONE ( ) |
| PAGER ( ) | PAGER ( ) |
| NAME | NAME |
| STREET | STREET |
| CITY STATE ZIP | CITY STATE ZIP |
| PHONE ( ) | PHONE ( ) |
| PAGER ( ) | PAGER ( ) |
| NAME | NAME |
| STREET | STREET |
| CITY STATE ZIP | CITY STATE ZIP |
| PHONE ( ) | PHONE ( ) |
| PAGER ( ) | PAGER ( ) |
| NAME | NAME |
| STREET | STREET |
| CITY STATE ZIP | CITY STATE ZIP |
| PHONE ( ) | PHONE ( ) |
| PAGER ( ) | PAGER ( ) |
| NAME | NAME |
| STREET | STREET |
| CITY STATE ZIP | CITY STATE ZIP |
| PHONE ( ) | PHONE ( ) |
| PAGER ( ) | PAGER ( ) |
| NAME | NAME |
| STREET | STREET |
| CITY STATE ZIP | CITY STATE ZIP |
| PHONE ( ) | PHONE ( ) |
| PAGER ( ) | PAGER ( ) |
| NAME | NAME |
| STREET | STREET |
| CITY STATE ZIP | CITY STATE ZIP |
| PHONE ( ) | PHONE ( ) |
| PAGER ( ) | PAGER ( ) |
| NAME | NAME |
| STREET | STREET |
| CITY STATE ZIP | CITY STATE ZIP |
| PHONE ( ) | PHONE ( ) |
| PAGER ( ) | PAGER ( ) |

54 22

ORDER YOUR 199_ APPOINTMENT BOOK NOW

NAME

ADDRESS

CITY STATE ZIP

24

PLEASE ENCLOSE PAYMENT IN FULL TO

APPOINTMENT BOOKS AVAILABLE IN 3 ASSORTED COLORS

WEEKLY APPOINTMENT BOOK 8 1/2 X 11

| COLOR | QTY | PRICE EA. | TOTAL |
|---|---|---|---|
| | | | |

DAILY APPOINTMENT BOOK 8 1/2 X 11

| COLOR | QTY | PRICE EA | TOTAL |
|---|---|---|---|
| | | | |

☐ CHECK ☐ MONEY ORDER

☐ VISA ☐ MASTER CARD

ACCT. EXP

SHIPPING & HANDLING

SIGNATURE TOTAL

Fig. 8a 56 22

32

| SERVICES 24 | PRICE | STYLIST ASST | TIME |
|---|---|---|---|
| 1. WOMENS HAIRCUT W/ BLOW DRY | | | |
| 2. WOMENS HAIRCUT NO BLOW DRY | | | |
| 3. MENS HAIRCUT W/ BLOW DRY | | | |
| 4. FULL HIGHLIGHT WITH HAIRCUT B/O | | | |
| 5. FULL HIGHLIGHT NO HAIRCUT | | | |
| 6. PARTIAL HIGHLIGHT WITH HAIRCUT | | | |
| 7. PARTIAL HIGHLIGHT NO HAIRCUT | | | |
| 8. PERM WITH HAIRCUT | | | |
| 9. PERM NO HAIRCUT | | | |
| 10. PARTIAL PERM WITH HAIRCUT | | | |
| 11. PARTIAL PERM NO HAIRCUT | | | |
| 12. TINT TOUCH UP WITH HAIRCUT | | | |
| 13. TINT TOUCH UP NO HAIRCUT | | | |
| 14. FIRST TIME COLOR (VIRGIN) | | | |
| 15. SEMI COLOR WITH HAIRCUT | | | |
| 16. SEMI COLOR NO HAIRCUT | | | |
| 17. BLEACH TOUCH UP WITH HAIRCUT | | | |
| 18. BLEACH TOUCH UP NO HAIRCUT | | | |
| 19. SHAMPOO BLOW DRY ONLY | | | |
| 20. EXTRAS | | | |
| ☆ TONERS | | | |
| ☆ BRAIDING | | | |
| ☆ EXTENSIONS | | | |
| ☆ COLOR CORRECTION | | | |
| ☆ | | | |

Fig. 9

ORGANIZED APPOINTMENT BOOK FOR A HAIRSTYLIST

BACKGROUND OF THE INVENTION

1. Field of the Invention

The instant invention relates generally to calendar schedule devices and more specifically it relates to an organizer guide book.

2. Description of the Prior Art

Numerous calendar schedule devices have been provided in prior art. For example, U.S. Pat. Nos. 2,505,417 to Maline; 4,043,063 to Ambasz; 5,030,027 to Bachrach et al. and 5,387,011 to Freund all are illustrative of such prior art. While these units may be suitable for the particular purpose to which they address, they would not be as suitable for the purposes of the present invention as heretofore described.

MALINE, CHARLES

DESK CALENDAR PAD

U.S. Pat. No. 2,505,417

A desk calendar pad that specifically pertains to an accessory for a desk, which provides an annual calendar and a memorandum pad in roll form. It is for conveniently presenting calendar data together with a memorandum pad surface for each of the days of a year in chronological sequence.

AMBASZ, EMILIO

APPOINTMENT CALENDAR BOOK

U.S. Pat. No. 4,043,063

An appointment calendar comprises a ring-type binder, at least one page having a pocket and a flap which partially slips into the pocket, and an insertion having two leaves, one of the leaves being received in the pocket to hold the insertion in place in the calendar and the other leaf, which contains printed promotional, decorative or informative matter, overlying the pocket so that the printed matter is visible. The pocket is closed along all margins except along an opening adjacent the edge of the page that is engaged in the binder. The binder rings engage the flap and a part of the page which is non-pocketed but do not engage the pocket or the insertion.

BACHRACH, SCOTT

BACKUS, ALAN L.

SCHEDULE AND PAPERWORK ORGANIZER

U.S. Pat. No. 5,030,027

A device to facilitate organization of educational and business schedules and paperwork, simultaneous with conveying varied graphic and social images. The device is a ring binder in which a time piece is mounted for easily viewing the time display. A pocket is provided on the front cover of the device for receiving and easily changing opaque and transparent imprinted sheets to alter appearance, while exposing the time display.

FREUND, WILLIAM D.

SYSTEM AND METHOD FOR SCHEDULING A MEETING

U.S. Pat. No. 5,387,011

A system and method for scheduling a meeting uses several partially translucent sheets, one for each prospective attendee. Each partially translucent sheet contains an array of blocks of time, in which the rows correspond to time periods and the columns correspond to dates. The prospective attendee darkens the blocks corresponding to times that he is not available to attend the meeting, and sends the completed sheet to the organizer. The organizer then assembles the sheets, and stacks and aligns them so that the blocks line up. By viewing the stack of partially translucent sheets, preferably with a light source, the organizer can quickly identify the times when all prospective attendees are available for the meeting by identifying those blocks that remain translucent. If each prospective attendee uses the same type of writing apparatus so that the intensity of the darkened blocks is consistent among all the prospective attendees, then when the organizer assembles the sheets, if no time is available that all prospective attendees can meet, the next best time and date is the block that appears lightest. This allows the organizer to identify the times that the most people can attend the meeting, and not just the time when everyone can attend the meeting.

SUMMARY OF THE INVENTION

A primary object of the present invention is to provide an organize appointment book for a hairstylist that will overcome the shortcomings of the prior art devices.

Another object is to provide an organize appointment book for a hairstylist that is a loose-leaf binder constructed to hold imprinted pages that can be especially used by the hairstylist, to book future clients more efficiently.

An additional object is to provide an organize appointment book for a hairstylist that will hold additional imprinted pages for addresses and telephone numbers, important dates, a reorder reminder, a reorder form and a price list to help aid the hairstylist.

A further object is to provide an organize appointment book for a hairstylist that is simple and easy to use.

A still further object is to provide an organize appointment book for a hairstylist that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figures 4, 4A:
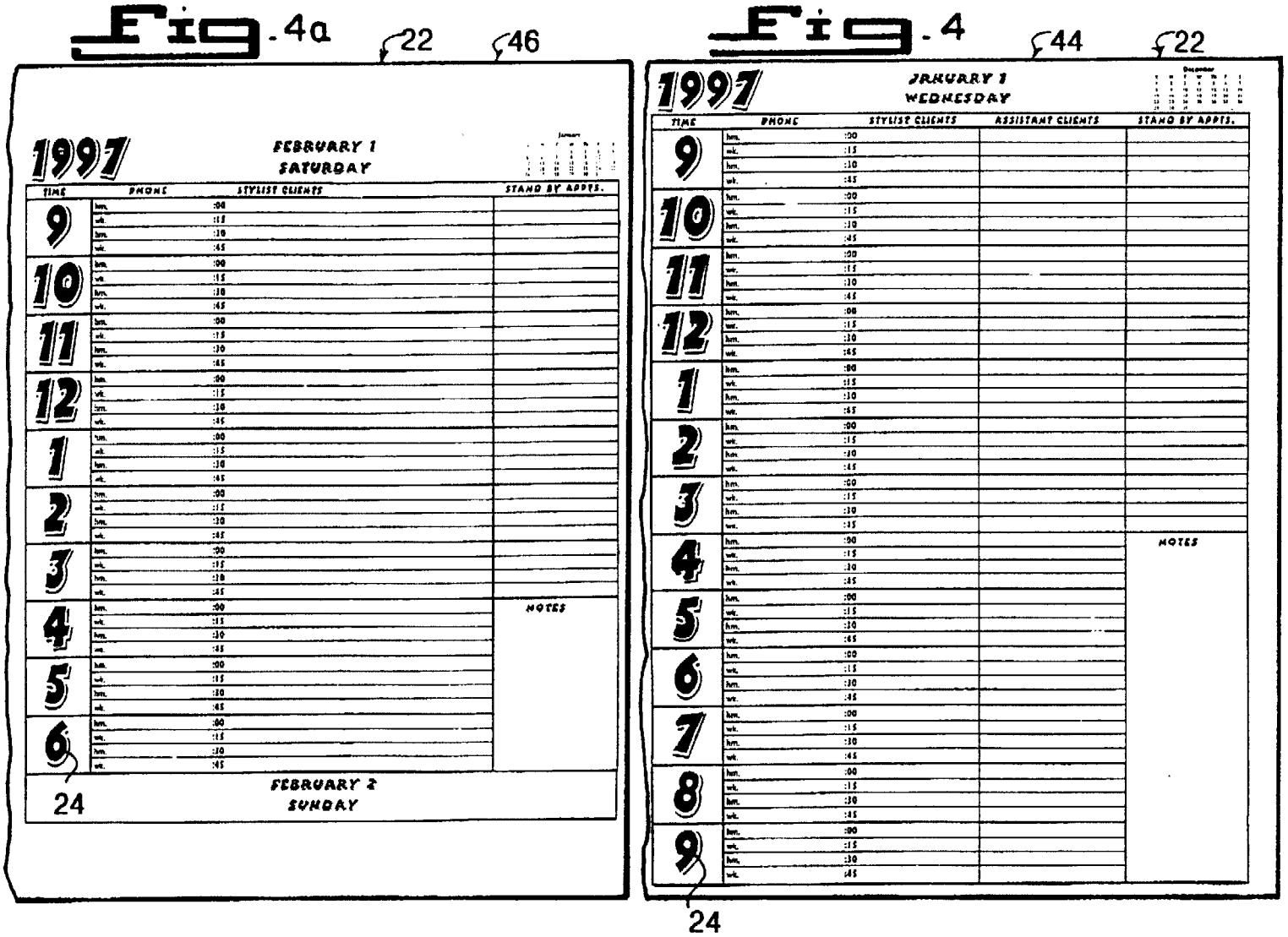
FIG. 4 is a plan view with parts broken away of a client booking sheet for a hairstylist with an assistant.

FIG. 4*a* is a plan view with parts broken away of an alternate client booking sheet for just the hairstylist.

FIG. 5 is a plan view with parts broken away of an address and telephone numbers sheet.

FIG. 6 is a plan view with parts broken away of an important dates sheet.

Figure 7A:
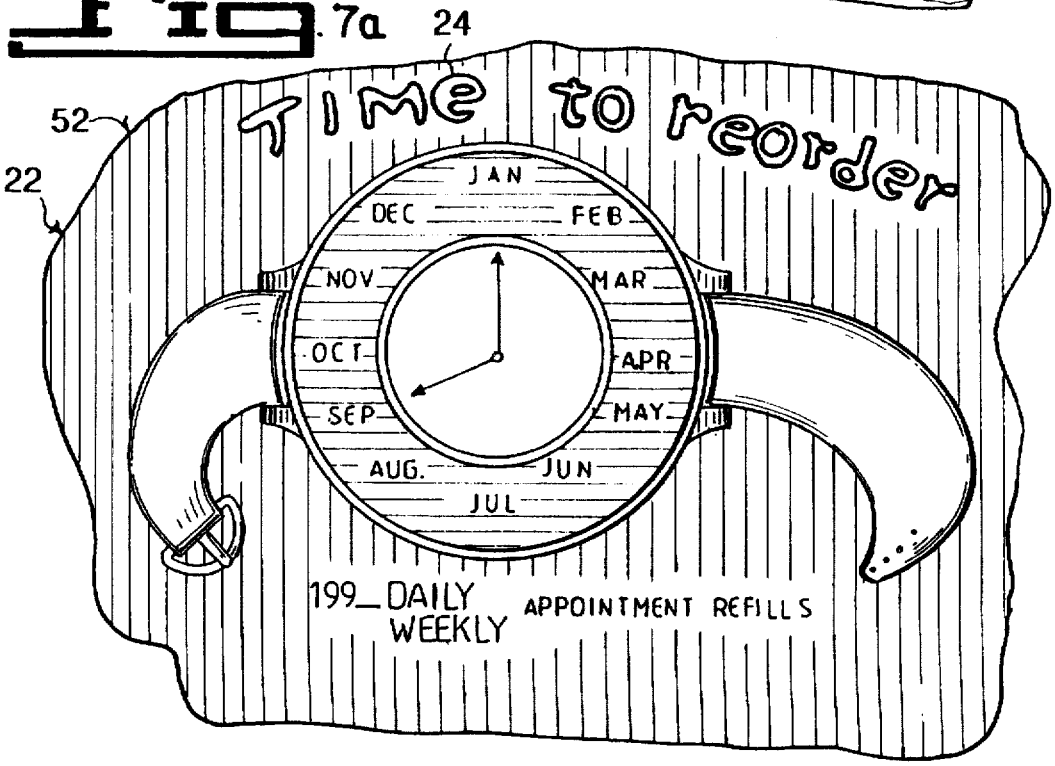
Figure 7:
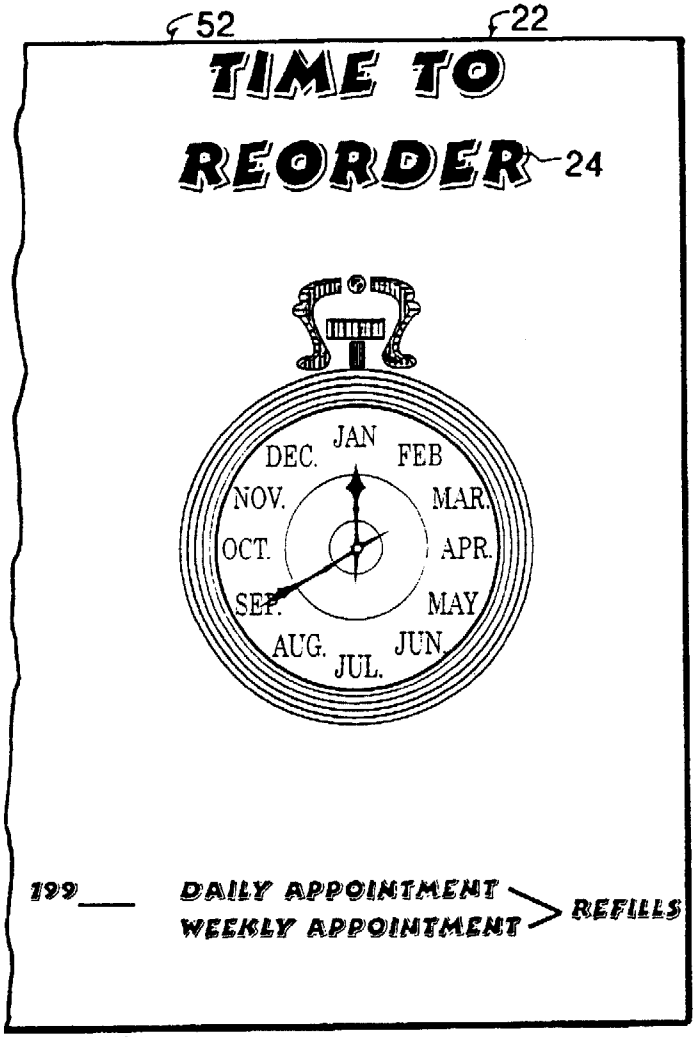

FIG. 7 is a plan view with parts broken away of an order reminder sheet.

FIG. 7*a* is a plan view with parts broken away of an alternate order reminder sheet.

Figure 8:
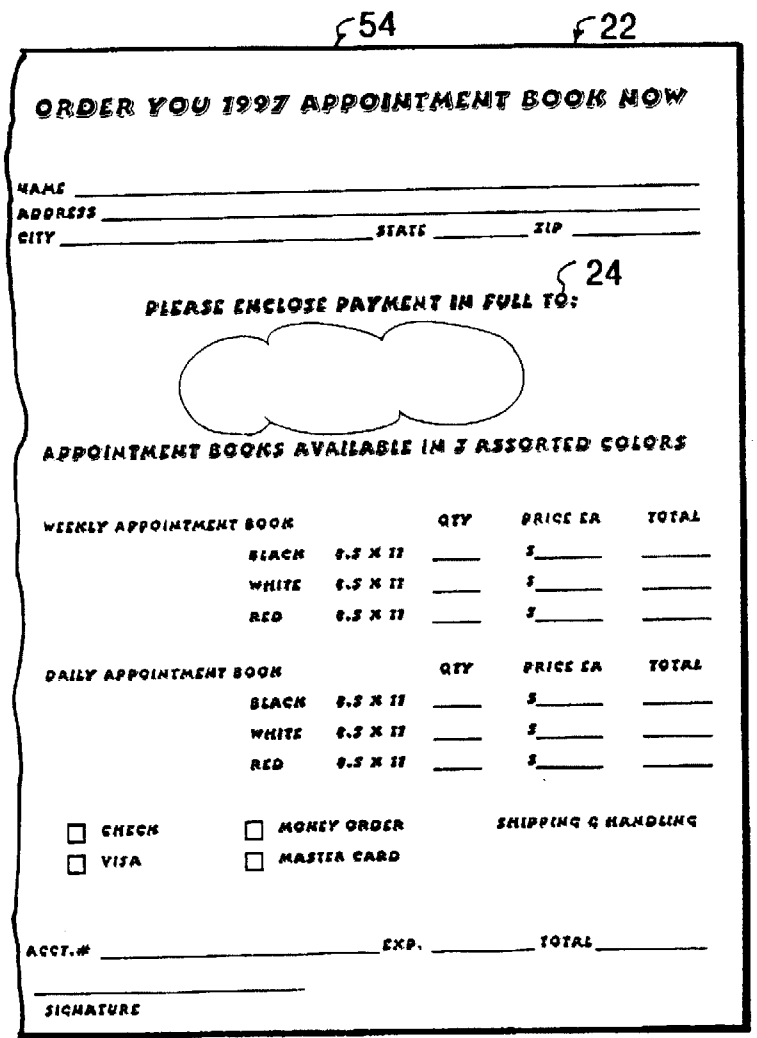

FIG. 8 is a plan view with parts broken away of an order form sheet.

FIG. 8*a* is a plan view with parts broken away of an alternate order form sheet.

FIG. 9 is a plan view with parts broken away of a price list sheet.

Similar reference characters denote corresponding features consistently throughout the attached drawings.

DETAILED DESCRIPTION OF THE PREFERRED EMBODIMENTS

Figure 1:
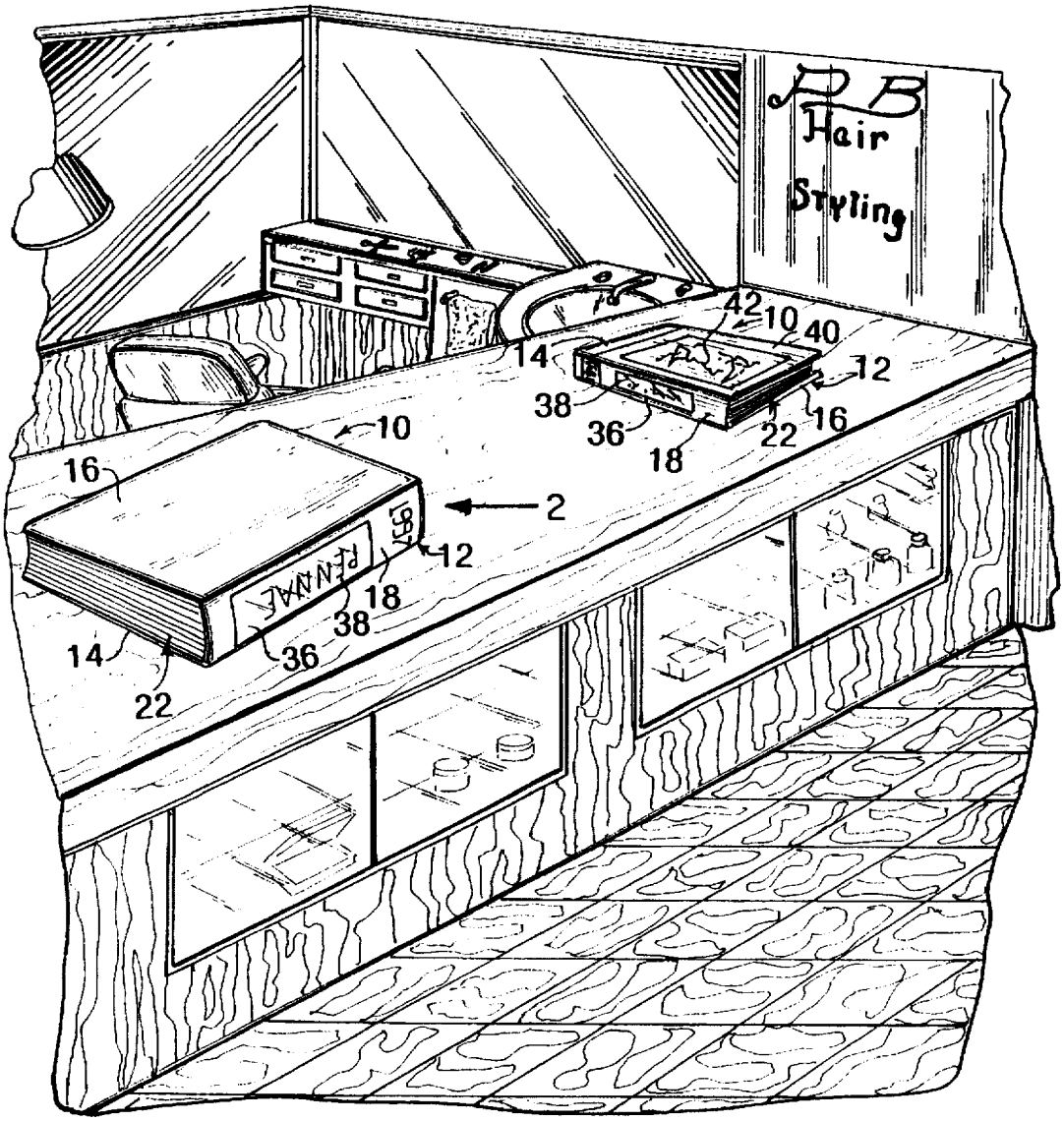
FIG. 1 is a perspective view showing two of the instant invention in closed positions on a counter in a hairstyling store.
Figure 2:
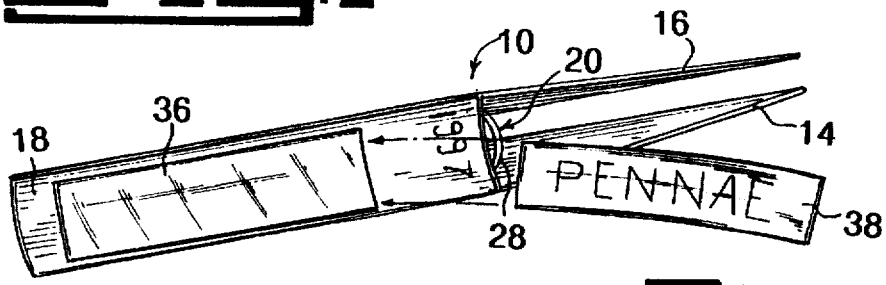
FIG. 2 is a perspective view taken in the direction of arrow 2 in FIG. 1, showing an imprinted name tag ready to be inserted into a transparent pocket on a spine of a loose-leaf binder.
Figure 3:
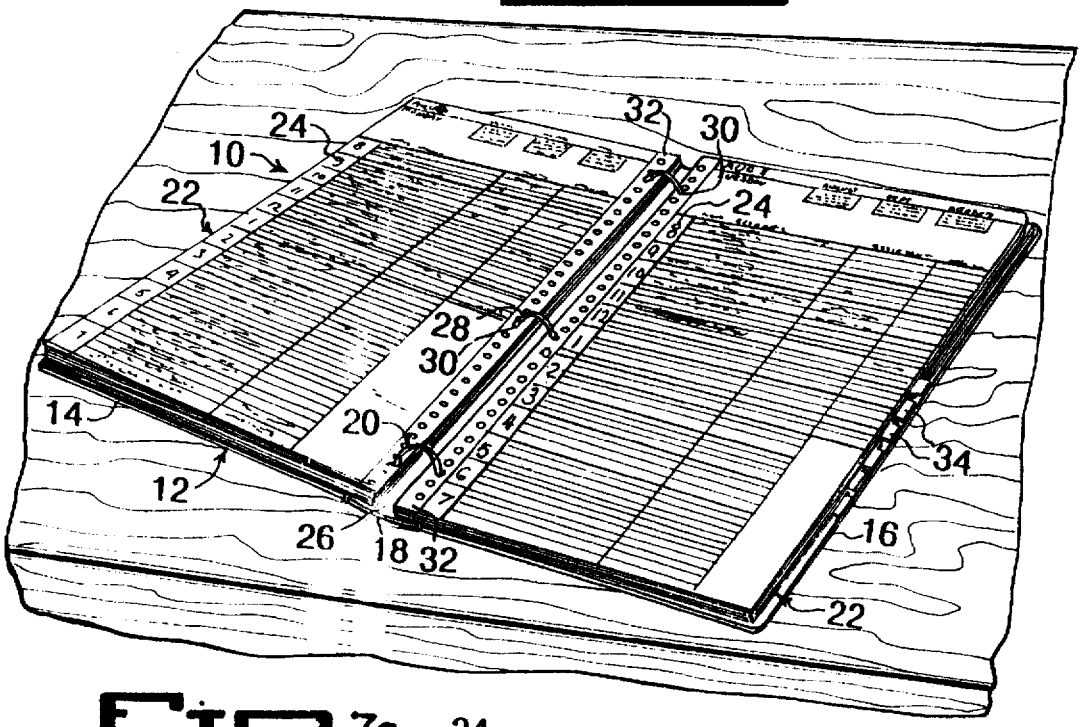
FIG. 3 is a perspective view of the instant invention in an opened position upon the counter.

Turning now descriptively to the drawings, in which similar reference characters denote similar elements throughout the several views, FIGS. 1 to 3 illustrate an organize appointment book for a hairstylist 10 comprising a loose-leaf binder 12 having a front cover 14 and back cover 16 hinged to a spine 18. A page holder 20 is mounted to the spine 18.

A plurality of imprinted pages 22 are detachably held by the page holder 20. Each imprinted page 22 bears printed indicia 24 thereon for providing information to the hairstylist using the organize appointment book for a hairstylist 10.

The page holder 20 includes a longitudinal base mechanism 26 connected to an inner surface of the spine 18. A plurality of openable ring connectors 28 are spaced apart and transversely connected to the base mechanism 26, to engage with openings 30 in a margin 32 of each imprinted page 22. A plurality of index tab dividers 34 are each attachably held by the page holder 20 between the imprinted pages 22, so as to arrange in monthly order the imprinted pages 22 within the loose-leaf binder 12.

A transparent side pocket 36 is on an outer surface of the spine 18. An imprinted name tag 38 of the hairstylist can be inserted into the transparent side pocket 36. A transparent front pocket 40 is on an outer surface of the front cover 14. A graphically imprinted sheet 42 can be inserted into the transparent front pocket 40.

One of the imprinted pages 22, as best shown in FIG. 4, is a client booking sheet 44 for the hairstylist with an assistant. One of the imprinted pages 22, as best seen in FIG. 4*a*, is a client booking sheet 46 for just the hairstylist. One of the imprinted pages 22, as best seen in FIG. 5, is an addresses and telephone numbers sheet 48.

One of the imprinted pages 22, as best seen in FIG. 6, is an important dates sheet 50. One of the imprinted pages 22, as best seen in FIGS. 7 and 7*a*, is a reorder reminder sheet 52. One of the imprinted pages 22, as best seen in FIGS. 8 and 8*a*, is an order form sheet 54. One of the imprinted pages 22, as best seen in FIG. 9, is a price list sheet 56.

The client booking sheet 44 for the hairstylist with an assistant in FIG. 4 and the client booking sheet 46 for just the hairstylist in FIG. 4*a*, both consist of an hourly scheduling calendar and are preprinted replaceable schedule sheets. The client booking sheet 44, as shown in FIG. 4, has four columns, which are from left to right. A first column for phone numbers (home and work), a second column for the hairstylist's clients names, a third column for the assistant's clients names and a fourth column for stand by appointments. The client booking sheet 44*a* in FIG. 4*a*, is similar to FIG. 4, but has three columns instead of four columns, with the column for the assistant's clients names eliminated therefrom. The addresses and telephone numbers sheet 48 in FIG. 5, has room for a plurality of names, addresses and telephone listings thereon. The important dates sheet in FIG. 6, lists all of the holidays of the year and their dates.

The reorder reminder sheet 52 in FIGS. 7 and 7*a* indicates the month, such as in September, for ordering a new organize appointment book 10 for the next year that is coming up. The order form sheet 54 in FIGS. 8 and 8*a*, can be filled out and sent in for the new order. The price list sheet 56 in FIG. 9, indicates prices for various hairstyling services and times available for the booking.

The imprinted name tag 38 that is inserted into the transparent side pocket 36 is the name of the hairstylist that will use it. The graphically imprinted sheet 42 for the transparent front pocket 40 can be changeable art, of any picture you want.

The loose-leaf binder 12 can come in different colors. There can also be an imprinted page at the back of the loose-leaf binder 12, to indicate major hair shows throughout the United States. A plastic card holder sheet the size of the imprinted pages 22 can be inserted into the loose-leaf binder 12, to hold various business cards of suppliers, vendors, etc. A clear plastic page marker can be provided, to drop down from a top left side and cover or hold an imprinted page 22 on the left side to act as a quick book marker.

List of Reference Numbers 10 organize appointment book
12 loose-leaf binder of 10
14 front cover of 12
16 back cover of 12
18 spine of 12
20 page holder of 10 on 18
22 imprinted page of 10
24 printed indicia on 22
26 base mechanism of 20
28 ring connector of 20
30 opening in 32
32 margin of 22
34 index tab divider of 10 on 22
36 transparent side pocket of 10 on 18
38 imprinted name tag of 10 in 36
40 transparent front pocket of 10 on 14
42 graphically imprinted sheet of 10 in 40
44 client booking sheet for a hairstylist with an assistant for 22
46 client booking sheet for just a hairstylist for 22
48 addresses and telephone numbers sheet for 22
50 important dates sheet for 22
52 reorder reminder sheet for 22
54 order form sheet for 22
56 price list sheet for 22

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An organize appointment book for a hairstylist comprising:

a) a loose-leaf binder having a front cover and back cover hinged to a spine;

b) a page holder mounted to said spine comprising a longitudinal base mechanism connected to an inner surface of said spine and a plurality of openable ring connectors spaced apart and transversely connected to said base mechanism to engage with openings in a margin of each said imprinted page;

c) a plurality of imprinted pages detachably held by said page holder, whereby each said imprinted page bears printed indicia thereon for providing information to the hairstylist using said organize appointment book, said imprinted pages including two types of client booking sheets with one for the hairstylist with an assistant and one for just the hairstylist with both booking sheets including specific provision for standby appointments, an addresses and telephone numbers sheet, an important dates sheet, a reorder reminder sheet, an order form sheet, and a price list sheet, said reorder reminder sheet comprising clocklike hands for indicating the date when a reorder is due with the minute hand indicating when a new appointment book is to be ordered;

d) a plurality of index tab dividers that are each detachably held by said page holder between said imprinted pages, so as to arrange in monthly order said imprinted pages within said loose-leaf binder;

e) a transparent side pocket on an outer surface of said spine and an imprinted name tag of the hairstylist which can be inserted into said transparent side pocket; and f) a transparent front pocket on an outer surface of said front cover and a graphically imprinted sheet which can be inserted into said transparent front pocket.

* * * * *